United States Patent [19]

Ali et al.

[11] 4,277,917

[45] Jul. 14, 1981

[54] SANDING, BUFFING AND/OR POLISHING WHEEL

[76] Inventors: Christopher A. Ali; Frank F. Ali, both of 2973 Pascal Dr., Fairborn, Ohio 45324

[21] Appl. No.: 31,382

[22] Filed: Apr. 19, 1979

[51] Int. Cl.[3] ..... B24B 9/02

[52] U.S. Cl. ..... 51/335; 15/230.16

[58] Field of Search ..... 15/230.16; 51/330, 331, 51/332, 334, 335, 336, 337

[56] References Cited

U.S. PATENT DOCUMENTS

| | | | |
|---|---|---|---|
| 2,439,962 | 4/1948 | Bonkowski | 51/335 |
| 2,522,920 | 9/1950 | Baltes | 51/335 |
| 2,533,619 | 12/1950 | Pokras | 51/335 |
| 2,720,064 | 10/1955 | Klug | 51/334 |
| 2,767,526 | 10/1956 | Moran | 51/335 |
| 2,771,721 | 11/1956 | Reiman | 51/335 |
| 3,165,867 | 1/1965 | Murray | 51/334 |
| 3,486,276 | 12/1969 | Block | 51/335 |
| 3,512,311 | 5/1970 | Block | 51/334 |
| 3,540,169 | 11/1970 | Mahoney | 52/335 |
| 3,846,942 | 11/1974 | Belanger | 51/334 |

*Primary Examiner*—Gary L. Smith
*Assistant Examiner*—Robert P. Olszewski
*Attorney, Agent, or Firm*—Jerome P. Bloom

[57] ABSTRACT

A sanding, polishing and buffing wheel comprises a housing having a plurality of longitudinally extending, circumferentially spaced, slots. Each slot is differentially spaced with respect to the adjacent leading and trailing slots, having regard for the direction of wheel rotation in use. Threaded through each of a plurality of widely spaced slots in the end of a separate strip of abrasively surfaced material, the remainder of the extended length of which is anchored to a non-radial fin on a spool and wrapped around the spool in the initial loading thereof within the housing. The spool is normally fixed and can, when necessary, be released and rotated relative to the housing to loosen the wrapping of the strip material and then fixed. Thereafter, on rotation of the wheel for application to a work piece, the outer portions of the strips will automatically feed out through the respective slots to effect a desired length of their projected end portions. The slot which immediately trails the projected end of a strip is closely adjacent and accommodates a slip fit, to the housing wall portion defining its trailing edge, of the channel shaped base of a multi-fingered firm but somewhat resilient backing element for the projected end of the adjacent strip.

2 Claims, 12 Drawing Figures

SANDING, BUFFING AND/OR POLISHING WHEEL

BACKGROUND OF THE INVENTION

This invention relates to improvements in sanding, buffing and polishing wheels rendering them economical to fabricate yet more rugged in construction, more efficient and satisfactory in use, adaptable to a wider variety of applications and less likely to lend themselves to malfunction in use.

The invention is particularly advantageous when embodied in a device capable of being fixed in the chuck of the power drive unit of a hand held tool and will be so described for purposes of illustration, but not by way of limitation.

The prior art of which the present inventors are aware comprises the following:

| U.S. Pat. No. | Inventor | Date |
|---|---|---|
| 394,747 | H. G. Wolcott | December 18, 1888 |
| 564,587 | W. Black | July 28, 1896 |
| 2,194,577 | A. Vonnegut | March 26, 1940 |
| 2,418,966 | T. L. Bonkowski | April 15, 1947 |
| 2,535,637 | B. L. Johnson | December 26, 1950 |
| 2,767,526 | J. O. Moran | October 23, 1956 |
| 3,132,452 | A. Block | May 12, 1964 |
| 3,165,867 | E. E. Murray | January 19, 1965 |
| 3,486,276 | A. Block | December 30, 1969 |
| 3,540,169 | G. R. Mahoney | November 17, 1970 |
| 3,774,354 | Donald M. Taylor | November 27, 1973 |

The present invention achieves an elimination of various undesirable features of the prior art devices. It enables a greater loading capacity for a wheel of the type described, with respect to the sanding, buffing or polishing material which it utilizes for its intended function. At the same time, it features a unique mode of projecting such material from and with respect to the outer peripheral surface of the wheel, as and when required. The design of the housing for the abrasive surface material is such to lend it strength and at the same time to facilitate an optimal orientation of the material in use. An improved backing device for the working portions of the abrasively surfaced strip material which the invention employs insures a firmly backed relation of those portions of the abrasive material which are operative and in a manner to facilitate the adapting of the material to the work surface to which it is applied to provide it with a uniform surfacing operation, the uniformity being to a degree not heretofore found in the art. These and other features of distinction which lend improvements over the prior art will become evident from the following description of a preferred embodiment.

SUMMARY OF THE INVENTION

A preferred embodiment of the invention features a sanding, buffing and/or polishing wheel the housing of which is made of plastic, preferably Lexan, the design of which not only lends strength but extended life to the unit of which it forms a part. The housing is provided with an arrangement of circumferentially spaced slots so paired with reference to a uniquely constructed and interiorly disposed spool of abrasively surfaced strip material as to provide that the end portion of a strip which is projected through the leading one of paired slots may be advantageously inclined to and supported by a firm resilient backing device during its function.

The backing device has a channel-shaped base by means of which it slip fits to a peripheral wall portion of the housing which defines an edge portion of the trailing slot of the pair, having regard for the direction of wheel rotation in use. While firm, the backing device is constructed and arranged to flex and adapt to diverse contours of a surface being worked, while maintaining a resistant bias on the working end portion of the strip which it backs. The result is a substantial uniformity in the working of a surface, irrespective of its contour.

The housing is basically comprised of a cup-shaped receptacle embodying the above mentioned slots so that they extend longitudinally of and substantially co-extensive with its peripheral wall. The slots open at one end from the edge of this wall which rims the opening to the mouth of the cup and defines its lip. This facilitates the initial projection from the housing of the ends of the strip material remote from those which anchor to the small diameter tubular hub portion of the spool, as well as the application of each backing device.

A cap for the receptacle is formed to provide a male-female connection thereof with the lip of the receptacle and a similar connection thereof with the hub of the spool, merely by its slip fit application.

The drive shaft of the wheel projects through the receptacle by way of a central aperture in its base, to which it is fixed. In the application of the spool its tubular hub slips over a threaded end of the shaft to nest within the receptacle and be fixed against rotation relative thereto as the cap of the housing is applied and suitably fixed in connection with the shaft. The shaft projects at one end in a sense outwardly of the base of the receptacle and may be suitably chucked to any appropriate power drive unit. A backing off of the cap from the receptacle permits the cap to be rotated, and the spool concurrently therewith, to loosen the wrapping of the strips about the hub of the spool. Thereafter, on re-application of the cap in connection with the receptacle to lock the cap and the spool against rotation with respect thereto and subsequent rotation of the wheel, the projected ends of the strips will be enabled to automatically feed out through their respective slots, to the extent predetermined by the degree of release of the wrapping.

The spool hub carries a series of circumferentially spaced non-radial substantially coextensive fins to each of which the inner ends of a pair of strips of abrasively surfaced material are anchored. On wrapping the pairs of strips about the spool defined by the hub and its fins, the arrangement is such to facilitate optimal orientation of the projected ends of the strips and their outfeed when required. The angle of the projected ends of the strips as supported by their backing devices effectively establishes a larger working diameter for the wheel than defined by the receptacle. A further feature is that the arrangement and configuration of the spool and the slots in the receptacle is such to enable maximum lengths of the strips as originally loaded in the receptacle. In the preferred form, the strips will be of different lengths.

A primary object of the invention is to provide a sanding, polishing and/or buffing device more economical to manufacture, more efficient and satisfactory in use and adaptable to a wide variety of normally difficult applications.

Another object is to provide an improved housing for such a device featuring a receptacle having a unique arrangement of slots facilitating assembly, loading and projection of abrasive strips and a maximum usage thereof at minimum cost.

A further object is to provide a uniquely fabricated spool for such a device. In conjunction therewith the invention also provides improved backing devices for the abrasive strips which the spool mounts, the construction and arrangement of which enables a strong but resilient application of the strips to a work piece in a generally uniform manner, irrespective of the work piece contour.

An additional object of the invention is to provide an assembly of abrasive strip devices to a cup-like housing in a manner to facilitate maximal loading thereof for a given size cup.

Another object is to provide a wheel for sanding, buffing and/or polishing utilizing a minimal number of abrasive surfaced strips, ends of which are projected through slots in the wheel housing and so arranged and backed as to achieve the effect of a wheel the diamter of which is greater than its actual diameter.

Another object of the invention is to provide a sanding, polishing and/or buffing wheel the composite and/or components of which possess the advantageous structural features, the inherent meritorious characteristics and the means and mode of use herein described.

Referring to the drawings wherein is shown a preferred but not necessarily the only form of the embodiment of the invention, FIG. 1 is an outer end view of an assembled sanding, buffing and/or polishing wheel in accordance with our invention;

Figure 3:
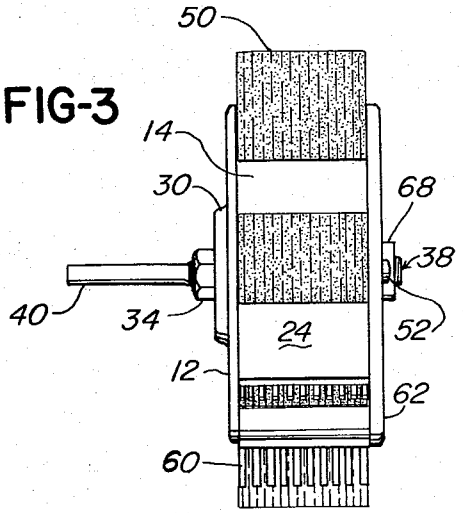
FIG. 3 is a side view.
Figure 2:
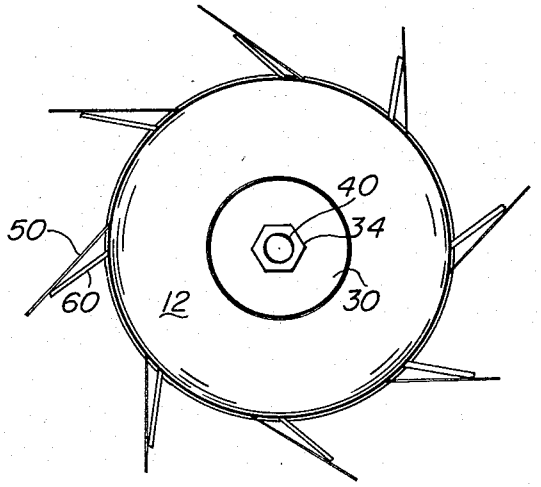
FIG. 2 is an opposite end view.
Figure 5:
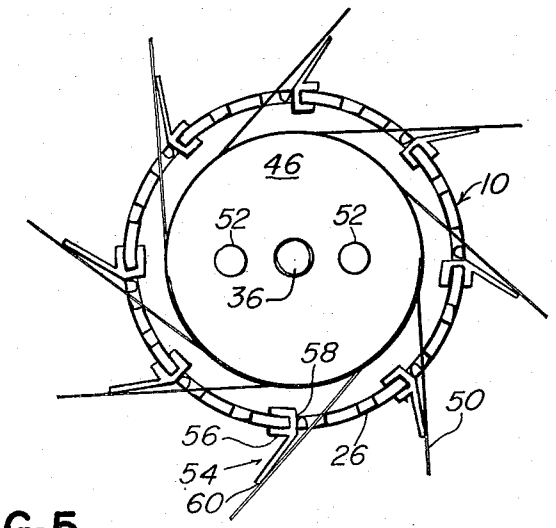
FIG. 5 is a view of the outer end of the assembly with the cap plate therof removed.
Figure 1:
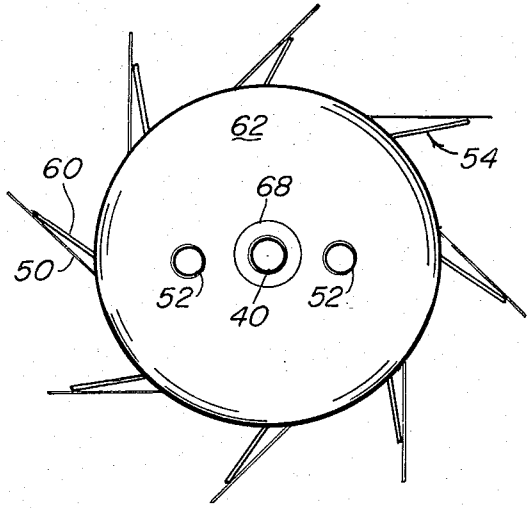
Figure 4:
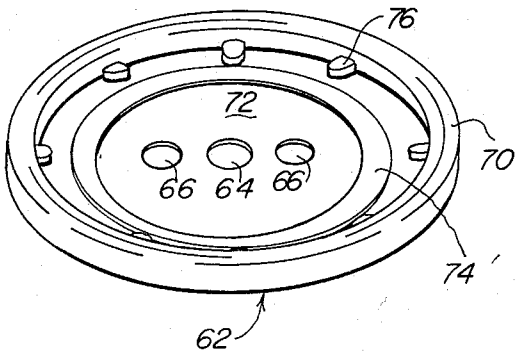
FIG. 4 is a perspective view of the cap portion of the invention unit, showing details of its inwardly disposed surface.
Figure 10:
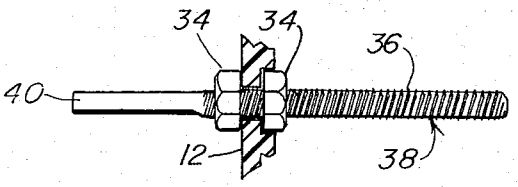
FIG. 10 is a view of the drive shaft of the assembly illustrating the relation of applied nuts which serve to clamp the shaft to the base of the cup shown in FIG. 9.
Figure 11:
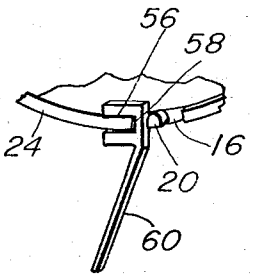
FIG. 11 is a fragmentary view enlarged to show the application of the backing devices to the cup wall.
Figure 12:
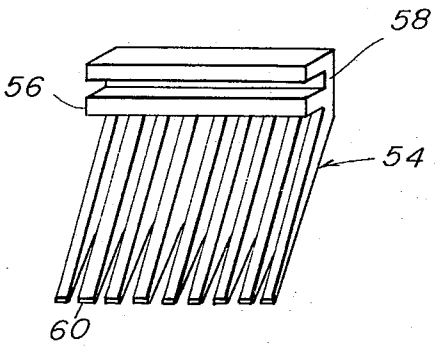
FIG. 12 is a perspective detail view of the backing device.
Figure 9:
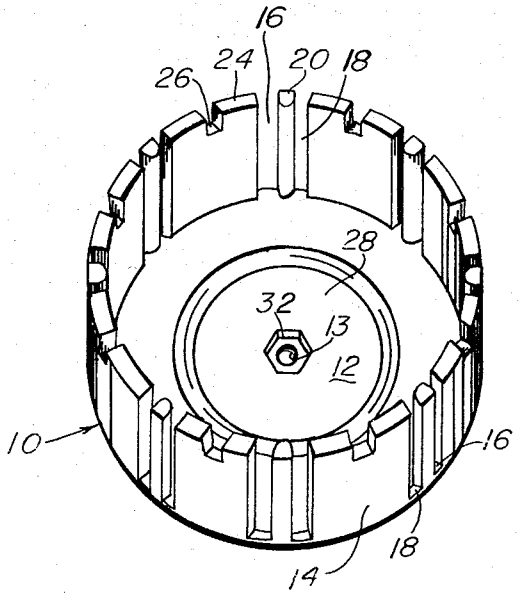
FIG. 9 is a perspective view of the cup portion of the assembly, showing its detail.
Figure 6:
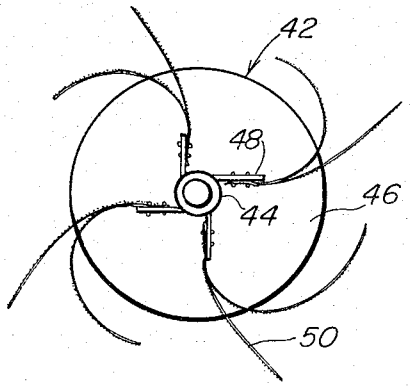
FIG. 6 is a view taken of the base end of the spool assembly embodied in the illustrated wheel.
Figure 7:
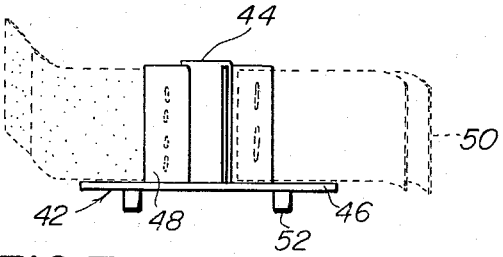
FIG. 7 is a side elevation view of the spool of FIG. 6 with its base shown uppermost.
Figure 8:
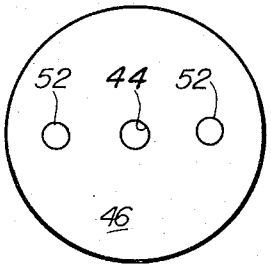
FIG. 8 is a view of the outer end of the spool.

The drawings show a cup-shaped element 10 including a base 12 having a substantial diameter the radius of which is greater in length than the axially projected length of its cylindrically formed peripheral wall structure 14 which projects perpendicular to the outer peripheral edge of its base 12.

The wall 14 is intersected by pairs of axially directed closely spaced slots. The slots of each pair, labelled 16 and 18 respectively, are equally and closely spaced and project perpendicular to and from the base 12, which closes one end of each thereof. The slots 16 and 18 open from the axially projected edge defining the lip of the cup.

The spacing of the slots 16 and 18 in each pair is such to define therebetween a portion of the wall 14 resembling a narrow finger-like projection perpendicular to the base 12. Such projection 20 is uniform in transverse section the length thereof and the contour of its outer peripheral surface in transverse section presents a U shaped portion the projected extremities of the legs of which lie in the outer surface of wall 14 and thus are bridged by a surface the curve of which has the radius of the outer wall surface of the cup. The apex of the U is directed toward the axial center line of the cup and the sides thereof respectively lie in leading and trailing edges of the projections 20, having regard for the cup rotation, and are substantially parallel to each other and to a radius of the cup.

The spacing between adjacent pairs of the slots is substantially greater in a sense circumferentially of the cup than that between the individual slots of a pair. This spacing provides that a major portion of the wall 14 consists of equidistantly and circularly spaced wall segments 24 having a relatively broad arcuate extent. Formed in the center of the axial projected extremity of each wall segment 24 is a rectangular notch 26 of the configuration of which approximates that of a square.

The base 12 has a disc form including a central aperture 11. It is flat except for an offset of a central portion producing a depression 28 in its surface which disposes inwardly of the cup 10 and at the same time the base has at its outer surface a corrsponding projection 30. The base surface of the depression 28 has a relatively small recess 32 at its center which is hexagonal in peripheral outline and provides a recessed relatively narrow shoulder designed to seat an hexagonal nut 34 in bounding relation to the aperture 13. The hexagonal wall surface closely confines the nut 34 to prevent its rotation about the aperture 13.

Projected through the aperture 13 and threaded through the nut 34 from the outer side of the base 12 is a threaded end portion 36 of a rod 38 which extends the major portion of the length of the rod, the opposite end portion of which is formd as a relatively reduced diameter shaft 40 the peripheral surface of which is somewhat roughened. In application of the rod 38, the threaded portion 36 thereof projects through and along the central axis of the cup 10 until its outer extremity projects beyond and outwardly of the axially projected extremity of the wall 14. A second nut 34 is applied to the innermost end of the threaded portion 36 which disposes outwardly of the base 12. As will be seen, when the threaded portion 6 is in place, the outer nut 34 will be tightened thereby to clamp the rod 38 in a fixed position wherein it is perpendicular to the base 12. At this point the shaft portion 40 will project outwardly of the cup 10 and perpendicular to the center of its base.

Slip fit over the projected extremity of the rod portion 36, to nest within the cup 10 is a small diameter tube 44 defining the hub of a spool 42. Formed integral with and about one end of the tube 44 is an annular plate portion 46 of substantial radial extent the outer diameter of which is slightly less than the inner diameter of the wall 14 of the cup 10. Also formed integral with the outer surface of the tube 44, substantially the length thereof, to join at one end to and integral with the plate portion 46 are four wing-like plate segments defining circumferentially spaced fins 48. The plate-like fins are each co-planar extension of a chord of the tube 44. The chords are substantially equal in length and so arranged that their composite would form a generally rectangular enclosure within the tube 44. As thus provided the fins are non-radial and have a limited degree of flexibility.

Fixed to each fin 48, at the same face thereof in each case, as shown, are the superposed inner ends of two longitudinally extended rectangular strips 50 of abrasively surfaced material. The abrasive material as here illustrated is of the type having laterally and closely spaced lines of slits, in each line of which the slits are in closely spaced end to end relation. The fixing of what constitutes the inner ends of the strips 50 is in this case by the application of staples, though other means of securing the strips to the thin plate-like projections 48 may be employed, though for purposes of ease and economy of assembly, other means are not preferred.

The spool 42 and the connected strips 50 are easily inserted within the cup 10, in the process of which the end of tube 44 remote from the integrated annular plate portion 46 is directed inwardly to the bottom of the cup 10 to seat against the nut 34 which has a recessed position in the center of inner surface of the base 12. The diameter and limited wall thickness of the tube 44 provies that its inwardly disposed end will have a bearing relation to the nut. The diameter of the outer periphery of the annular plate portion 46 and the length of tube 44 is such that as the spool 42 seats, the outer periphery of the plate portion 46 lies within and spaced radially from the lip of the cup. The outer surface of plate portion 46 and the projected end of the wall 14 defining its lip will be essentially co-planar. Intermediate its diametral limits, the outer surface of plate portion 46 has formed integral therewith, on diameter thereof and spaced equidistantly from and to opposite sides of its center, a pair of perpendicular stud-like projections 52. The projections 52 project outwardly from the cup and beyond the lip defined by the projected extremity of the cup wall 14.

As the spool 42 and the attached strips 50 are applied in the cup, the pairs of strips attached to fins 48 are commonly wrapped about the hub 44 in a direction counter to its rotation in their use. In the process of such application the outer ends of the individual strips 50 of each pair are respectively inserted in a different one of a pair of successively adjacent slots 16 in the cup 10. With the strips applied to their slots so one thereof projects through each slot 16 is formed in the wall 14, and the spool 42 seated in the cup, the stud-like projections 52 may be grasped by the fingers of one hand while the cup is held in the other and with a turning of the spool in the direction in which the cup is intended to rotate in use the strips will be pulled inwardly of the slots 16 in unison. In the course of this the strips wrap uniformly and closely to and about tube portion 44 and its plate-like fins 48, so as to leave a predetermined length of their respective outer end portions which project outwardly of the slots 16.

Slip fit in each slot 18 and to the peripheral wall portion of cup 10 which defines its trailing edge is a backing device 54 for the adjacent outwardly projected end of the strip 50 which it immediately trails, having regard for the direction of wheel rotation in use. The device 54 includes a channel-shaped base portion the length of which is slightly less than the projected axial length of the wall 14. In cross-section this channel-shaped portion has a uniformly rectangular U-shape, the parallel leg portions 56 of which are thicker than the base portion 58 by which they are joined and with which they are integrated at one end. The relatively thinner base portion 58 is laterally extended at one edge by a series of integral fingerlike elements 60. The elements 60 are formed at an angle to the base portion 58 to bend away from the plane thereof approximately 15°, in the direction of the channel leg 56 which projects perpendicular to the edge of the base from which the fingers project. The channel-shaped portion of the device 54 is so sized as to enable it to be slipped over the leading edge of a wall segment 24, having regard for the intended direction of rotation of the cup 10 in use. In the application of the device 54 the side walls 56 of the channel will find themselves in a slip fit contact respectively with the inner and outer wall surfaces of the segment 24 to which it is applied. In the process of the application of the device 54 the base 58 slip fits in the slot 18 in the wall 14 immediately in advance of the wall segment to which it is applied, with clearance between it and the finger-like portion 20 of the wall 14 which is adjacent thereto and in advance thereof. This application disposes the finger-like projections 60 in an outwardly projected relation to the all 14 and in backing inclined relation to the projected end of the strip 50 immediately in advance thereof, and spaced therefrom, at its base, by a finger portion 20 of the wall 14. The arrangement is such that both fingers 60 of the device 54 and the projected end of the leading abrasive strip 50 adjacent thereto are bent away from the direction of rotation of wall 14 in use of the invention embodiment. The angle which the projected end of the strip makes with the wall 14 in the preferred embodiment illustrated will be between 45° and 60°, in the direction of the fingers 60. At the same time the fingers 60 will be bent from a radial, counter to the direction of rotation, about 15°.

As thus provided, there will be a series of end portions of strips 50 projected outwardly of the wall 14 in a circumferentially spaced relation, respectively through one of the slots 16, and there will be in immediate backing relation thereto, anchored to the leading edge of one of the wall segments 24, a backing device 54 which by means of fingers 60 essentially each aligned with one of the strip portions of the abrasive material in advance thereof, defined by slits in the material, will insure that as the ends of the strips are applied to material to be sanded, buffed or polished, there will be a firm resistant bias of the fingers on the material and a uniform working of the surface to which the material is applied. The form and arrangement of the fingers 60 is to provide that each thereof will essentially back one of the strip portions of the abutted abrasive material, which strip portions separate, one from the other, as they work a surface. Of course, the abrasive surface of the strips 50 will be in advance of their backing device as applied to a work surface.

In this preferred embodiment the fingers 60 are relatively strong and have a limited degree of resiliency. This degree of resiliency will be such to enable the material which it backs to have the strips thereof bent one relative the other when the same is applied to the finishing of a contoured portion of a surface. The arrangement is such that one might smoothly operate on curved surfaces and even on surfaces wherein there is a right angled bend, into the corners thereof.

Applied in capping relation to the open mouth of the cup 10, after the spool 42 is housed therein, is a disc-shaped plate 62. The plate 62 has a central aperture 64 and spaced equidistantly to either side thereof, on the same diametral line, a further aperture 66. The aperture 64 is formed to be slightly larger in diameter than the threaded portion 36 of the rod 38 so that, as the plate 62 is applied to cap the spool 10 and the spool 42, the projected end of the rod portion 36 will pass through the plate to be threadedly engaged by a nut 68 which may be used to clamp the plate in a covering relation to the cup mouth. In the process the two studs 52 on the spool plate portion 46 project through the apertures 66 which are aligned therewith. The apertures 66 have a diameter only slightly larger than that of the studs 52.

The plate 62 has a shallow flange 70 formed integral with its peripheral edge and projecting from the face 72 thereof which faces inwardly of the cup. Also formed integral with the face 72 and projecting perpendicularly therefrom is a shallow annular projection 74 which is concentric to the aperture 64 and in a closely adjacent spaced relation to the flange 70, outwardly of the apertures 66. The outer peripheral surface of the annular projection 74 and the inner peripheral surface of flange 70 define therebetween, with the face 72, an annular channel the radial width of which is just sufficient to cup the projected extremity of the wall 14 defining the lip of the cup 10, as the plate 62 is applied. Within this channel and spaced equidistantly and circularly thereof, in connection with the inner wall of flange 70, are a series of lug-like projections 76. The projections 76 are equal in number to the notches 26 centered in the outer ends of the wall segments 24 and identically spaced. In the application of the cup plate 62 to close the mouth of cup 10 and contain the spool 42 and its connected strips 50, one of the lug-like projections 76 seats in each of the rectangular notches 26. This precludes rotation of the cap plate relative to the cup, once properly applied. Turning the nut 68 down on the cap plate insures this condition. By turning the nut 68 and the nut 34 on the remote end of the threaded body portion of the rod 36, outwardly of the base of the cup 10, towards each other, the cup 10 and the cap plate 62 are firmly secured and the shaft portion 40 of the rod 36 will then project outwardly from the base of the cup to the degree desired for its application to a chuck for power drive of the entire wheel unit of the invention in a rotative fashion. The arrangement does, of course, permit axial adjustment of the rod 38 relative to the cup 10 and its contained and connected structure.

The illustrated embodiment may be summarized as to its assembly, the interrelation of its parts and their function, as follows:

A preferred sanding, buffing and polishing wheel per the invention is made of plastic and characterized by a cup nesting therein, about a portion of its drive shaft and to its base, a spool of abrasive strip material. A nut threaded about the portion of the drive shaft within the cup serves also as a bearing for the base end of the small diameter tube providing the hub of the spool, the remote end of which has an integrally radial projected annular plate which substantially fills the mouth of the cup with some clearance therebetween and embodies a pair of diametrically aligned outwardly projected studs. These studs are received in corresponding apertures in the cap plate for the cup which embodies projections from its inwardly disposed surface adapted to nest in correspondingly circularly spaced notches in the cup lip. With the cap so disposed, the cap and spool are locked against rotation relative to the cup. The lock is insured by a nut applied over the outer projected extremity of the threaded portion of the drive shaft, which projects through a central aperture in the cap. Backing off of this nut holding the cap plate to the cup by a slight amount disengages its projections from the lip of the cup and permits a rotation sufficient to displace its projections to align with and fit in different notches in the cup lip as the cup is reseated and clamped once more to the cup. Such rotation is effected when it is desired to produce a wrapping or unwrapping of the abrasive strips attached to the spool hub so that portions thereof may have a selectively projected relation to the peripheral wall of the cup, through slots in the cup wall.

The spool within the cup includes a small diameter tube as its hub the outer surface of which embodies four fins which not only project the length thereof, but in a circumferentially and equidistantly spaced relation. Note, in the case illustrated in the fins are positioned so inward extensions would be in a sense generally tangential to the inner wall surface of the tubular hub 44. The strips of abrasive material are arranged so the inner ends of two are fixed to each of the fins, to one side and to the same face thereof. This makes eight strips in all, one for each of the eight slots through which the material is projected from the cup wall 14. Note in particular that the recessing in the base of the cup of that nut 34 which clamps to its interio wall surface permits that the width of the strips corresponds substantially to the distance from the base of the cup to the flange of the applied cap.

On insertion of the spool 42 within the cup 10, the strips commonly wrap around the fins in the same direction and the outer end of each strip is threaded into and through one of the eight slots in the cup wall, through the open end thereof. Initially the outer end of each strip 50, accommodated by appropriate rotation of the spool, will be pulled outwardly from the cup to have its projected end extend outwardly of the wall 14 further, to a slight degree, than its backing device 54.

As described, the many fingers of each device 54 which are co-planar are in application of the device to the cup wall 14 angled about 15° from a radial and closer to the radial than the strip end which it backs. This produces, in the application of the abrasive surfaces of the strip ends to a work piece an insurance that they fully apply to the work piece surface and with a backing pressure which resiliently accommodates though firmly resists the displacement or shifting of the abrasive working material. By virtue of the substance of the fingers 60, in application of the abrasive they adapt to fit various contours and corners which may be formed in the work piece. This insures an optimal surfacing of the work piece which is uniform, irrespective of its contour, to an optimal degree. Note that the form of the spool hub, the fins and the connection thereto of the inner ends of the strip material produces a feeding and projection of the strip ends to incline from the direction of the cup or wheel rotation approximately 45°, as backed by the device 54. Keep in mind also that when projected ends of strip 50 are worn, the nut 68 can be backed off, the cap plate 62 displaced from connection to the cup 10 and the cap may be then rotated a desired increment to rotate spool 2 and loosen the wrapping thereon of strips 50 to a desired degree whereupon the cap may be reapplied and fixed as described. On application of the wheel to its drive unit and rotation thereof for use, the centrifugal and other forces developed cause an automatic projection of the outer ends of the strips to the extent permitted by the loosening of their wrapping.

Particular attention is directed to the design of the channel shaped base portion of the device 54 which gives the device and the attached integral fingers strength while permitting the fingers to have a limited degree of flexing to accommodate contouring applications. Note further that the cross section and position of the finger-like portion 20 in advance of the channel portion of each device 54 accommodates a slight floating adjustment of the channel portion slip fit to the trailing edge of a wall portion 24 of the cup as reactant pressure occurs in the sanding operation.

As noted, it is preferred that the abrasive strip material be of the slit type which provides that as the projected portions of the strip ends function on a work piece the strips device into narrow finger-like segments respectively backed by the fingers 60 of a device 54 facilitating working into corners and recesses of a work piece in the application thereof.

The arrangement of the fins on the hub of the spool enables not only that the hub may be of small diameter but that a maximum loading capability is given the unit as to the available length of the applied strips for a given size cup.

Viewing the drawings, it may be seen that while only a limited number of strips need be employed in the invention embodiment, the arrangement insures that the composite of their projected ends serves in application of the wheel to give the effect of an essentially 360° abrasive surface wrapped around a circumference the diameter of which is actually greater than that of the cup 10.

As can be seen the inner ends of the strips applied to the spool may be simply and inexpensively stapled in pairs to enable ease of application and even replacement if desired. As to the lengths of the strips, they are differentially cut in the first instance to provide that they come out even at their ends. When ends of the strips become worn, the cap 62 may be released to back off the projections 76 from the notches 26 in the cup wall and rotated. By virtue of the studs 52 engaged in apertures 66 of the cap 62 this will rotate the spool in direction counter to the direction of rotation of the wheel in use to provide a release of the strip wrapping and bias therein of further portions of the strips outwardly facilitating that on rotation of the unit the movement with reference to the cup and its backing devices is automatically and responsively induced.

The devices 54 are made slightly less in width than the accommodating slots giving them a slight degree of axial floating capability to further accommodate flexibility in application of the abrasively surfaced strip ends. The whole contributes to the end result of a simply designed primarily plastic molded unit the interrelation of the parts of which are such to afford ease of assembly and disassembly and economy of manufacture and use. The unit and the applied strips nevertheless function with maximum efficiency and utility.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A sanding, polishing and/or buffing wheel comprising a housing for a spool of strips of abrasively surfaced material, said housing having a plurality of pairs of longitudinally extending circumferentially spaced slots one slot of each pair acommodating the projection therethrough of one end of a strip of the abrasively surfaced material which is anchored to said spool which is applied within and normally fixed for rotation with said housing, the other slot of each of said pairs being a trailing slot with reference to said one thereof considering the direction of rotation of the housing, said trailing slot accommodating, in each case, a firm but resilient element slip fit therein to provide a backing device for the projected end of the strip of adhesively surfaced material which is most adjacent thereto and immediately in advance thereof, said resilient element including a channel shaped portion serving as its base, which is slip fit into a trailing slot to fit about the trailing portion of the housing wall at the trailing edge of said slot.

2. A device as in claim 1 wherein said resilient element as fit to said housing has a portion projecting outwardly therefrom in a non-radial relation thereto, inclining from the direction in which said housing rotates.

* * * * *

UNITED STATES PATENT AND TRADEMARK OFFICE

CERTIFICATE OF CORRECTION

PATENT NO. : 4,277,917

DATED : July 14, 1981

INVENTOR(S) : Christopher Ali and Frank Ali

It is certified that error appears in the above-identified patent and that said Letters Patent are hereby corrected as shown below:

IN THE ABSTRACT, line 7, "in" is corrected to read -- is --.

Col. 3, line 20, "diamter" is corrected to read -- diameter --;

line 39, "therof" is corrected to read -- thereof --.

Col. 4, line 24, "11" is corrected to read -- 13 --;

line 39, "formd" is corrected to read -- formed --;

line 48, "6" is corrected to read -- 36 --;

line 65, -- a -- is inserted following "each".

Col. 5, line 22, "vies" is corrected to read -- vides --;

line 31, -- a -- is inserted following "on".

Col. 6, line 20, "all" is corrected to read -- wall --;

line 62, "corners" is corrected to read -- corner --.

UNITED STATES PATENT AND TRADEMARK OFFICE

CERTIFICATE OF CORRECTION

PATENT NO. : 4,277,917

DATED : July 14, 1981

INVENTOR(S) : Christopher Ali and Frank Ali

It is certified that error appears in the above-identified patent and that said Letters Patent are hereby corrected as shown below:

Col. 7, line 2, "spool" is corrected to read -- cup --;

line 28, "cup" is corrected to read -- cap --;

line 32, "to" is deleted following -- relative --;

line 64, "to" is deleted following -- relative --.

Col. 8, line 14 "in" (second occurrence) is deleted following -- illustrated --;

line 23, "interio" is corrected to read -- interior --;

line 54, "device" is corrected to read -- devices --;

line 58, "2" is corrected to read -- 42 --.

Col. 9, line 12, "device" is corrected to read -- divide --;

line 38, -- a -- is inserted following "in".

Signed and Sealed this

*Third* Day of *November 1981*

[SEAL]

*Attest:*

GERALD J. MOSSINGHOFF

*Attesting Officer*

*Commissioner of Patents and Trademarks*